United States Patent [19]

Bacus et al.

[11] Patent Number: 5,070,231

[45] Date of Patent: Dec. 3, 1991

[54] ROLL-FUSING ASSEMBLY AND METHOD FOR THERMAL COMPENSATION IN AN ELECTROPHOTOGRAPHIC PRINTER

[75] Inventors: Michael W. Bacus; Dick T. Price, both of Spokane; Dale A. Lewis, Otis Orchards; Michael E. Demarchi, Spokane; Karl L. C. Homa, Chattaroy; Gary McInturff, Spokane; Robert Gruell, Newman Lake, all of Wash.

[73] Assignee: Output Technology Corporation, Spokane, Wash.

[21] Appl. No.: 600,751

[22] Filed: Oct. 18, 1990

[51] Int. Cl.[5] ..... H05B 1/00; H05B 11/00

[52] U.S. Cl. ..... 219/216; 355/282; 355/285

[58] Field of Search ..... 355/282, 285, 289, 290, 355/295; 219/216, 243, 10.57; 346/160, 157.3; 432/60

[56] References Cited

U.S. PATENT DOCUMENTS

| | | | |
|---|---|---|---|
| T967,010 | 2/1978 | Stryjewski | 432/60 |
| 3,884,623 | 5/1975 | Slack | 432/60 |
| 4,019,024 | 4/1977 | Namiki | 219/469 |
| 4,594,068 | 6/1986 | Bardutzky et al. | 432/60 |
| 4,724,303 | 2/1988 | Martin et al. | 219/216 |
| 4,884,501 | 12/1989 | Izaki et al. | 355/295 |

*Primary Examiner*—A. T. Grimley
*Assistant Examiner*—Sandra L. Brase
*Attorney, Agent, or Firm*—Well, St. John & Roberts

[57] ABSTRACT

A roll-fusing assembly for printing upon continuous length print stock of substantially different widths and thicknesses includes structure for compensating for differences in thermal expansion across the pressure roller when engaging differing print stock widths. In a preferred embodiment this includes stepped pressure roller sections of reduced diameters and a contacting heat transfer roller for normalizing surface temperatures across the width of the pressure roller. The disclosed method involves normalizing surface temperatures across the pressure roller to compensate for the differences in thermal expansion that will occur about the pressure roller exterior directly exposed to the heated fusing roller when handling relatively narrow continuous length print stock or stock of differing thicknesses.

26 Claims, 7 Drawing Sheets

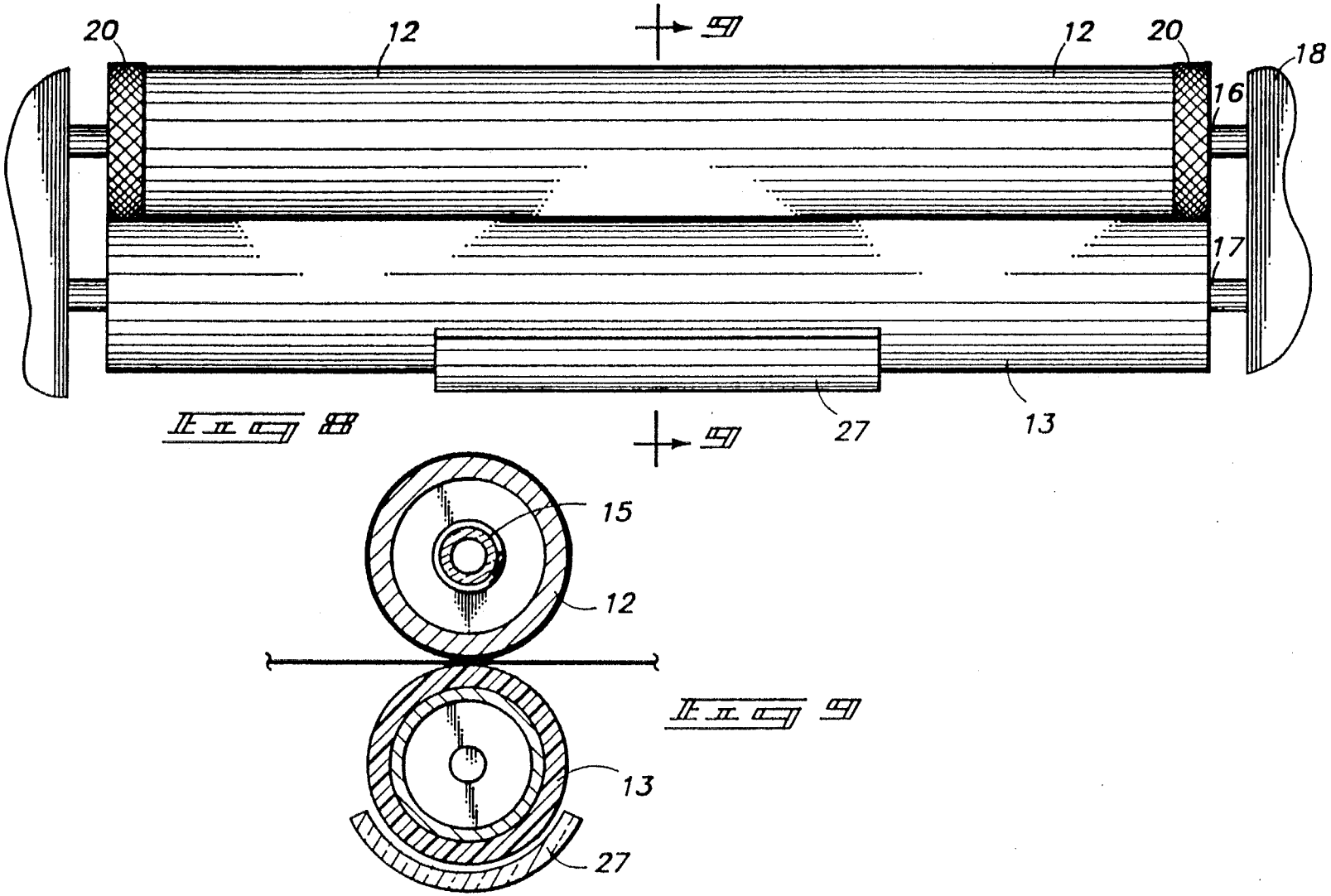
18
16
17
20
12
13
27
5
5
12
20
8
8
15
12
13
27
5

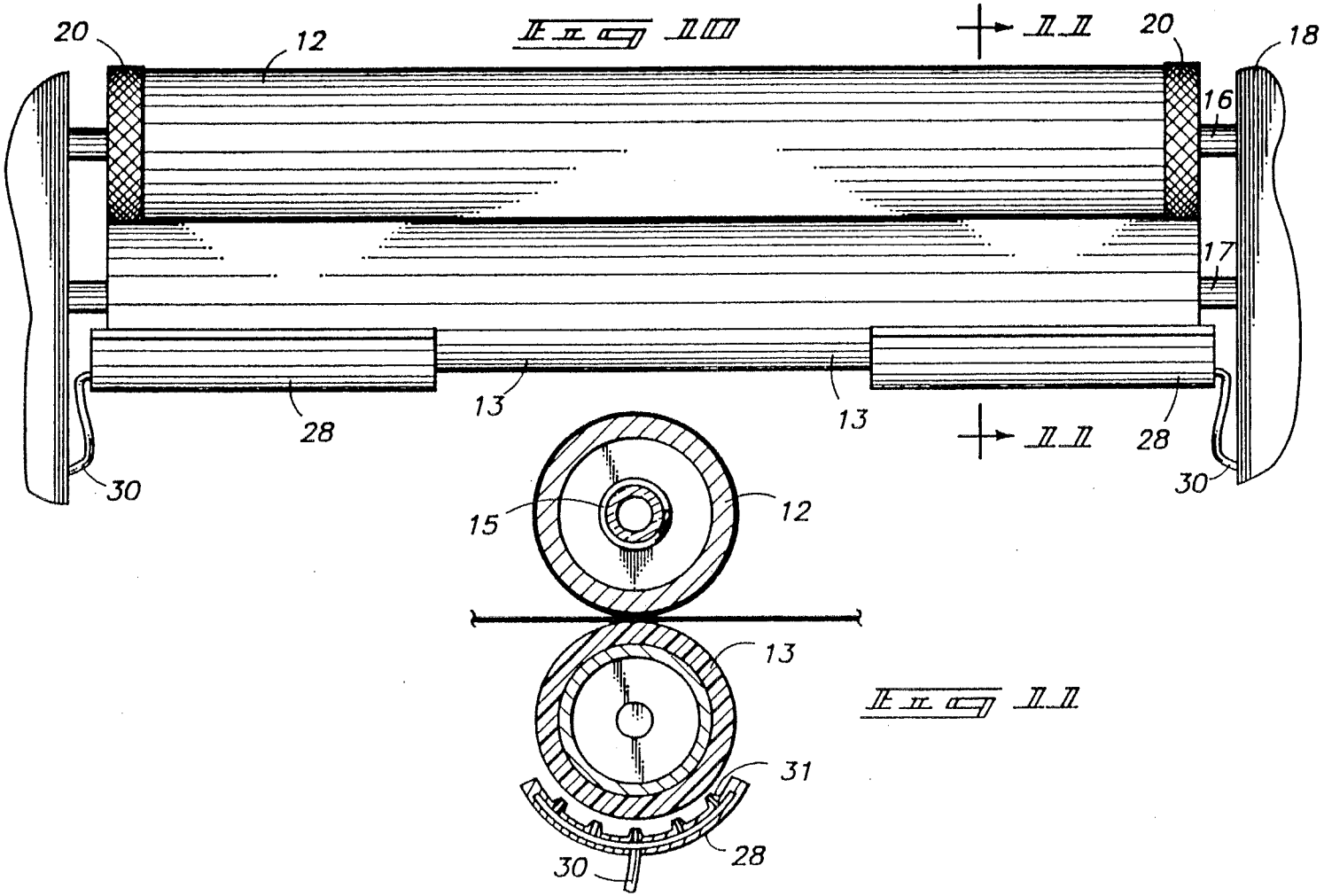
18
16
17
20
30
28
II-II
II-II
13
12
13
II-II
II-II
II-II
12
13
31
28
30
15
28
12
20
30

ROLL-FUSING ASSEMBLY AND METHOD FOR THERMAL COMPENSATION IN AN ELECTROPHOTOGRAPHIC PRINTER

TECHNICAL FIELD

This invention relates to modification of the roll-fusing assembly of an electrophotographic printer (commonly known as a laser printer) and to a method for thermal compensation to normalize surface temperatures across the roll fusing assembly, thereby facilitating the usage of continuous length print stock of differing widths in such printers.

BACKGROUND OF THE INVENTION

The present invention arose from an effort to develop equipment and methods to compensate for differences in thermal expansion conditions encountered across transverse sections of the pressure roller in a roll-fusing assembly.

Roll-fusing assemblies are well-developed with respect to copying machines and printers designed to individually print and handle single sheet print stock. Background discussions and illustrations can be found in U.S. Pat. Nos. 3,884,623, 4,019,024, and 4,594,068, as well as in U.S. Defensive Publication No. T967,010 (published Feb. 7, 1978).

The roll-fusing apparatus provided in an electrophotographic printer typically includes a yieldable pressure roller mounted in rolling opposition to an internally heated fusing roller. The externally driven fusing roller fuses a toner image on print stock as it passes through a rolling nip between the opposed rollers.

Stock feeding difficulties have been encountered when attempting to adapt electrophotographic printer technology to the printing and handling of continuous length print stock, such as paper or labels supplied in roll or bi-fold configurations. While single sheet electrophotographic printers can accommodate print stock of varying widths, speed variations in the roll-fusing apparatus that result from differences in print stock widths and thicknesses are of no substantial consequence because of the relatively short print stock length over which such differences occur. However, even very small decreases in print stock speed (linear velocity) through a roll-fusing assembly will cause the tension of the print stock located upstream from the roll-fusing assembly to slacken, thereby detracting from resulting print quality.

A one percent speed variation, when continuously running print stock at a typical linear speed of 3 inches per second, will result in a progressively changing length increase of 0.03 inches per second in the print stock immediately upstream from the roll-fuser assembly. The resulting bow or "bubble" in the continuous length print stock (see dashed line 14' in FIG. 1) is unacceptable to quality printing results, which require constant linear speed to be imparted to the print stock as it passes through the roll-fusing assembly.

The conventional fusing and pressure rollers provided within a roll-fusing apparatus have cylindrical exterior surfaces of constant diameter across their respective widths. The heating elements included within the fusing roller are typically continuous across the roller widths, being designed for intermittent operation when printing single sheets or materials. Temperatures across the roller surfaces are substantially constant under normal operating conditions encountered in the roll-fusing assembly when running single sheets. The rollers engage one another directly a substantial proportion of their operational time. Variations in heat transfer patterns across the rollers due to differing print stock widths and thicknesses are transient and averaged between the discrete sheets.

When *continuous* length print stock of differing widths and thickness is fed through the center of the opposing pair of rollers, meaningful differences in the pattern of heat transfer from the fusing roller to the pressure roller can result across the roller widths. These variations can be attributed to changes in the insulating effect of the print stock interposed between the heated fusing roller and the opposed yieldable pressure roller. Over a period of time the end section of the pressure roller, that directly engage the exterior of the fusing roller, will be warmed to a higher operational temperature than its central section, which is separated from the fusing roller by the continuous length print stock. The thermal variations that result across the rollers can affect printing results in ways not encountered when using single length print stock.

It has been found that continuously running narrow print stock through a roll-fusing assembly designed to also handle wider stock, and differences in the thicknesses of print stocks run through the fuser, can result in greater amounts of thermal expansion occurring at the ends of the pressure roller than at its center. This causes the center of the roller to reduce the feeding pressure on the narrow width print stock, which in turn results in a reduced linear speed being imparted to it and causes misregistration in the printer. Since the upstream linear velocity of the print stock is constant, decreases is the linear velocity of the print stock through the roll-fusing assembly will cause the stock to bow or form a "bubble" adjacent to the fusing roller, detracting from printing quality.

BRIEF DESCRIPTION OF THE DRAWINGS

The preferred embodiments of the invention are illustrated in the accompanying drawings, in which:

FIG. 6 is a transverse elevation view of a second embodiment;

FIG. 8 is a transverse elevation view of a third embodiment;

FIG. 9 is a cross-sectional view taken along line 9—9 in FIG. 8;

FIG. 10 is a transverse elevation view of a fourth embodiment;

FIG. 12 is a transverse elevation view of a fifth embodiment;

FIG. 13 is a transverse sectional view of a roller assembly illustrating modifications to the fusing roller structure; and FIG. 14 is a transverse sectional view through a roller assembly, illustrating modifications to the pressure roller structure.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
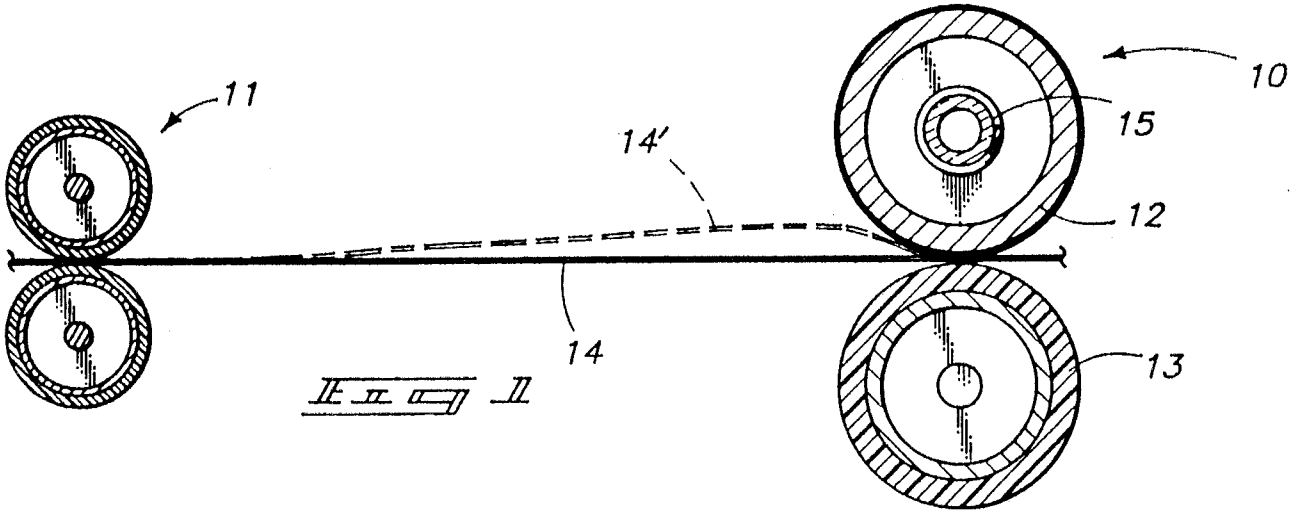
FIG. 1 is a schematic cross-sectional view illustrating operation of a roll-fuser.
Figure 2:
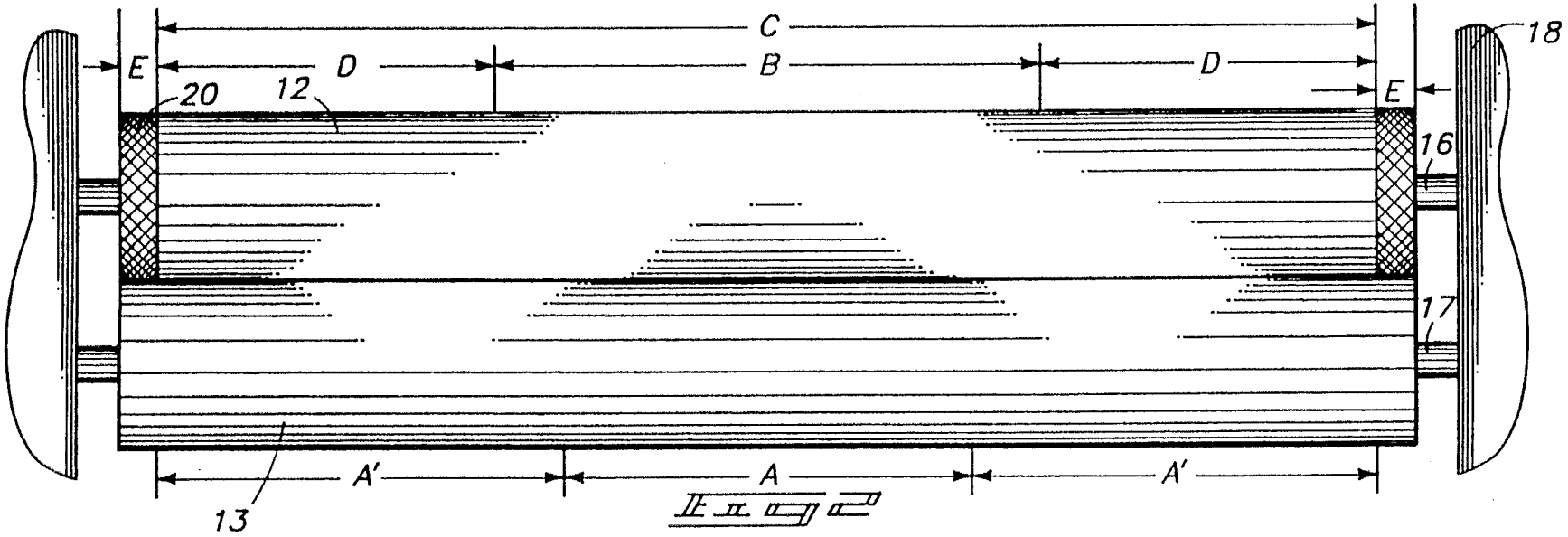
FIG. 2 is a transverse elevation view of the paired fusing and pressure rollers.

The present improvements pertain to a roll-fusing assembly and method for moving continuous length print stock between paired pressure and fusing rollers that are rotatably mounted alongside one another in the fuser section of an electrophotographic printer. FIGS. 1 and 2 illustrate a roll-fusing assembly 10 arranged within a printer at a location downstream from a print stock feeding apparatus 11. The roll-fusing assembly 10 includes a fusing roller 12 and pressure roller 13 that oppose one another and form a rolling nip to engage opposite surfaces of print stock 14. The feeding apparatus 11 can be frictional, but in the case of continuous length print stock, it will typically include a tractor feed assembly having sprockets (not shown) that match marginal perforations through the side edges of the print stock.

The present improvements pertain to printers designed to print on continuous length print stock 14 selected from substantially different minimum and maximum print stock widths, as well as different stock thicknesses. The print stock can be plain or coated paper, or laminations of individual labels with continuous length backing sheets. It might or might not include marginal perforations for tractor feed purposes.

In the disclosed embodiment, fusing roller 12 is a tubular metal roller, typically made from aluminum or other metal and coated with a polymer cover, such as a layer of Teflon. It is internally heated by a coaxial heating element 15. Heating element 15 typically extends across the full width of fusing roller 12 and is designed to uniformly heat its surfaces to melt toner (not shown) on the surface of print stock 14 engaged by roller 12.

The pressure roller 13 adjacent to and in pressing engagement with the fusing roller 12 is typically not heated apart from its contacting engagement with the heated outside surface of fusing roller 12. The diameters of rollers 12 and 13 are usually identical. Pressure roller 13 typically is constructed as a cylindrical metal roller having a relatively thick cylindrical elastomeric cover for pressing engagement against the more rigid surfaces of the fusing roller 12. Rollers 12 and 13 are supported on protruding shafts 16 and 17, respectively, which in turn are mounted by bearings (not shown) in the printer frame 18. The supporting shaft 17 for pressure roller 13 is spring biased toward the opposed fusing roller 12 to apply a predetermined pressure across the rolling nip formed between the rotating rollers.

A motor or other drive assembly (not shown) is operably connected to fusing roller 12 to power it at a constant rotational velocity. The outer ends of fusing roller 12 include knurled sections 20 which frictionally engage the cylindrical end sections of the elastomeric cover on pressure roller 13 to synchronize rotation of the two rollers by driving them in unison at a constant speed relative to the print stock feeding apparatus 11 or other associated print stock handling assemblies in the printer. The widths E of the transverse sections of rollers 12 and 13 across which rotational movement is transferred between them is identified in FIG. 2. The roller widths C between these two end sections define the effective maximum media width.

The difficulties that led to the present invention can best be understood by reference to FIG. 2, which illustrates a transverse view across fusing roller 12 and pressure roller 13. No substantial feed problems are encountered when adapting a conventional roll-fusing assembly in an existing single sheet printer to the handling of continuous length print stock of a width extending substantially across rollers 12 and 13. However, web control problems arise when printing upon substantially narrower continuous length print stock, such as stock having the width indicated in FIG. 2 at B, and when printing upon differing stock thicknesses. Under these conditions, the web of print stock upstream of rollers 12 and 13 gradually forms a bow or "bubble" as the tension in the print stock gradually lessens during a long printing run. This bowing effect is illustrated in dashed lines at 14' in FIG. 1.

The apparent cause of the bowing of relatively narrow print stock or stock of differing thicknesses is believed to be related to differences in thermal expansion or growth across portions of the roller widths when handling differing print stock widths and thicknesses. Because the print stock itself acts as a heat insulator between rollers 12 and 13, a greater amount of heat is transferred from fusing roller 12 to pressure roller 13 across the areas E contacting knurled sections 20 and across the outer transverse roller zones D (FIG. 2) than across the central zone B overlapped by the print stock. As a result, the outside diameters of pressure roller 13 across the sections E and D are increased relative to its outside diameter across central zone B. This changes the spring forces urging roller 13 toward roller 12 and modifies the area of contact between the rollers across a portion of their respective widths. The changes in frictional engagement between rollers 12 and 13 when running narrow or thicker print stock in a continuous manner have been found to decrease the linear print stock speed, causing formation of the bow or "bubble" upstream of the roll-fusing assembly shown at 14' in FIG. 1. The resulting misregistration in the printer is unacceptable when printing on continuous media, and becomes progressively worse over the length of a given print run.

The present invention is directed to an apparatus and method for compensating for the differing thermal expansion conditions encountered across the pressure roller 13 when printing on continuous length print stock of varying widths and thicknesses in an electrophotographic printer.

Figure 3:
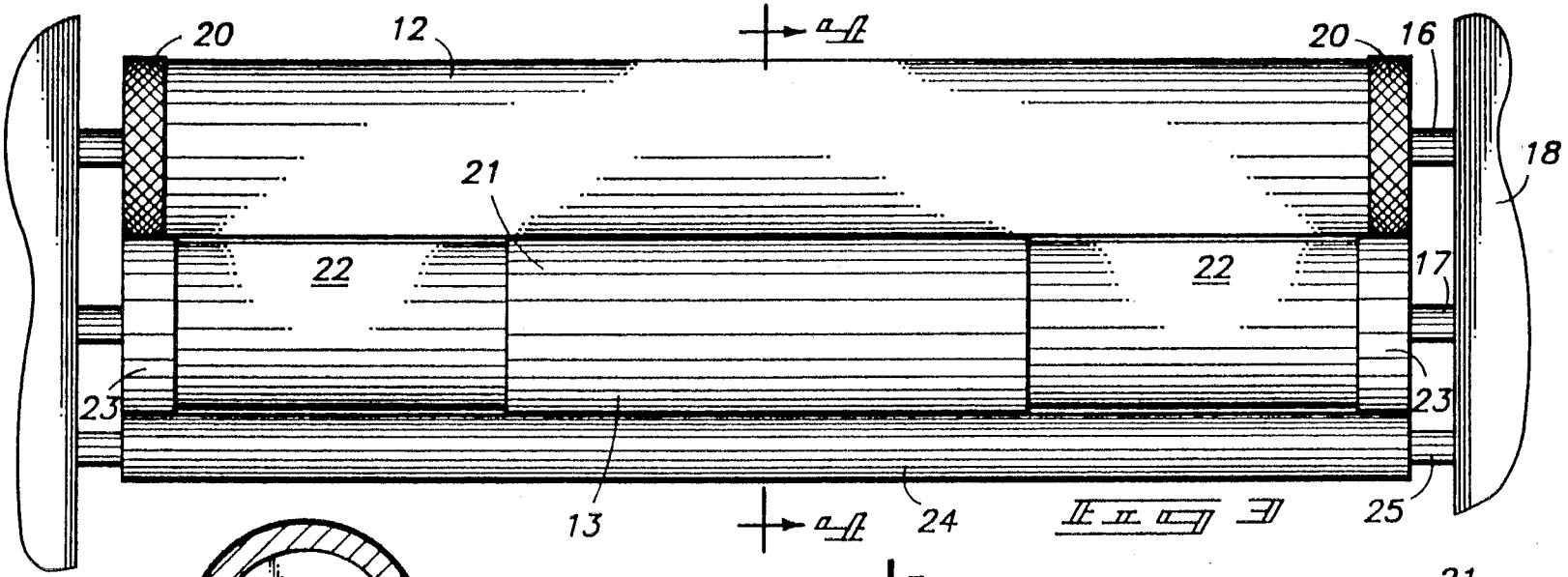
FIG. 3 is a transverse elevation view of a first embodiment of the invention.
Figure 5:
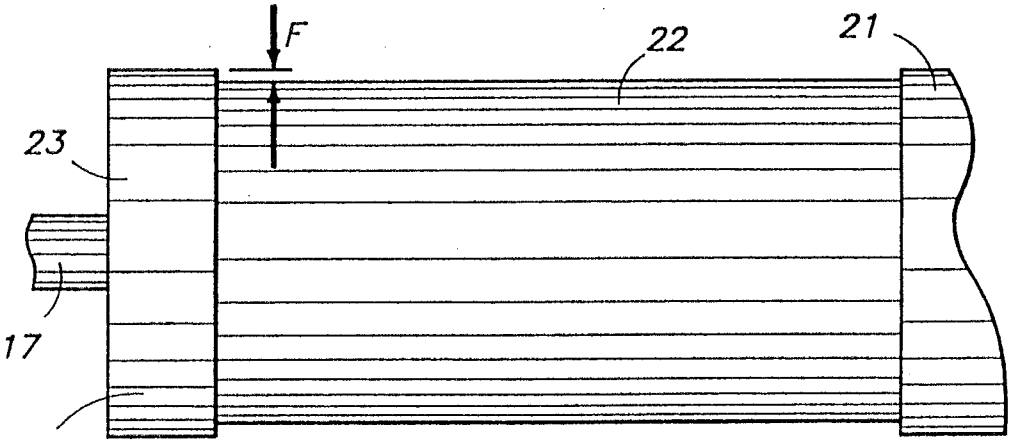
FIG. 5 is an enlarged transverse elevation view showing one end section of the pressure roller illustrated in FIG. 3.
Figure 4:
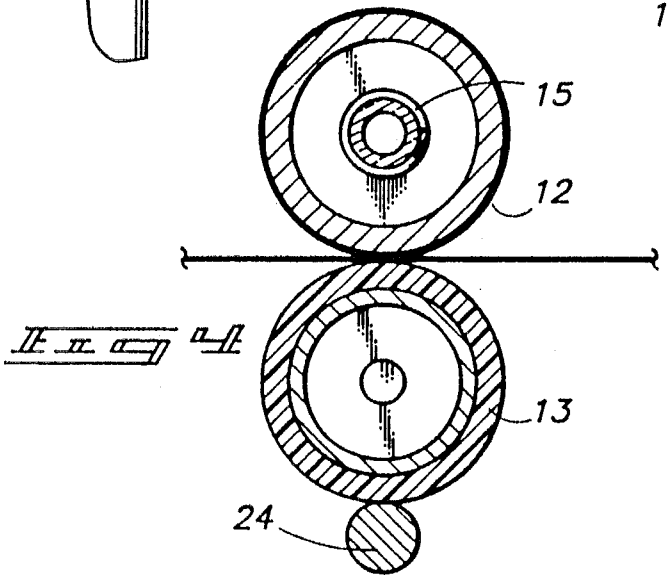
FIG. 4 is a cross-sectional view taken along line 4—4 in FIG. 3.
Figure 5:
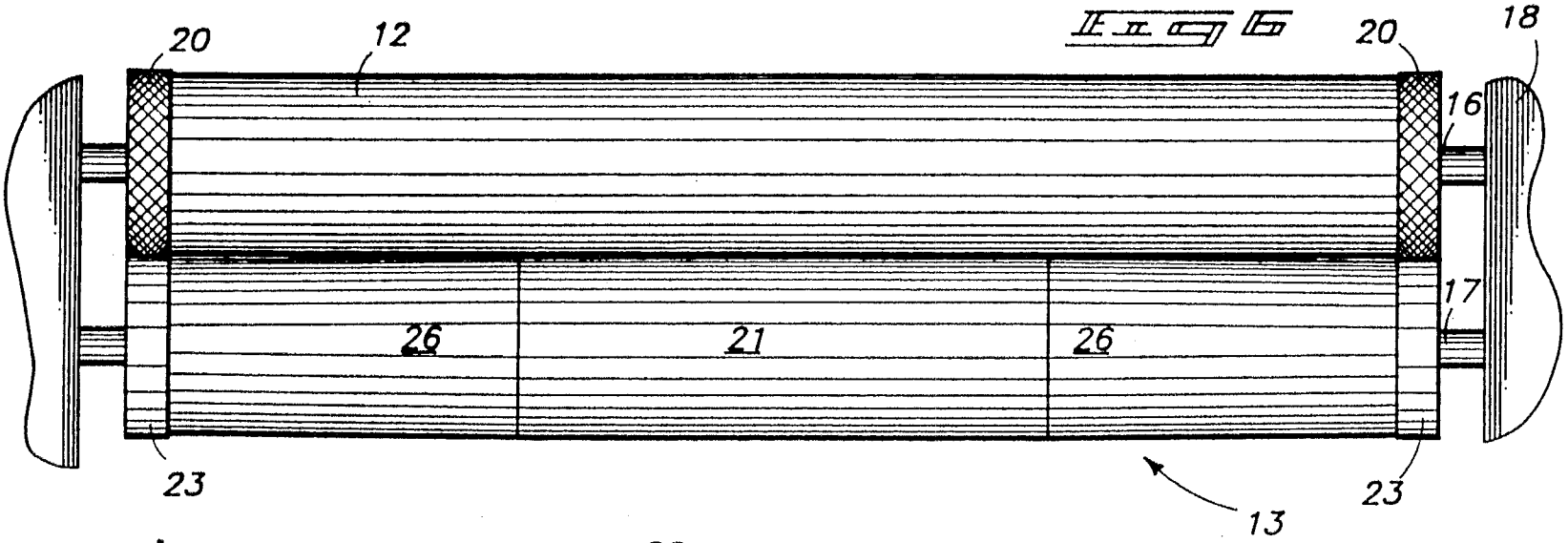

FIGS. 3–5 illustrate the preferred embodiment of the invention. In this form, the pressure roller 13 is divided into five transverse sections—a central cylindrical transverse section 21; outer stepped transverse sections 22; and end sections 23.

The end sections 23 frictionally engage the knurled sections 20 of fusing roller 12 and are unchanged from the roller configuration illustrated in FIG. 2.

The central cylindrical transverse section has an outside diameter equal to that of the end sections 23 and a transverse width slightly less than or equal to the minimum print stock width B identified in FIG. 2. This width A is graphically illustrated at the bottom of FIG. 2.

The outer transverse sections 22 have outside diameters slightly less than the outside diameter of central transverse section 21. Their transverse widths A' are equal to the spacing between section 21 and each end section 23.

The stepped nature of the cylindrical surfaces across roller 12 can best be viewed in the enlarged presentation of FIG. 5. The difference in diameters between the outer surface across section 22 and the outer surfaces across sections 21 and 23 is graphically illustrated at F.

In a typical roll-fusing assembly, the pressure roller 13 is mounted on supporting frame 18 so as to be compressed against the fusing roller 12 (following an initial warm-up period) by a preselected radial dimension. In the roller configuration shown in FIGS. 3-5, the differences between the outside diameters of the stepped cylindrical surfaces 21 and the outside diameter of the cylindrical surface formed across the central transverse section 21 of the pressure roller 13 are less than the preselected radial dimension to which the pressure roller 13 is normally compressed against the fusing roller 12 during printer operation.

As an example, if the elastomeric exterior of pressure roller 13 is normally compressed against the engaged cylindrical surface of fusing roller 12 by a distance of about 0.050 inches, an acceptable range for the stepped distance F across the outer transverse sections D of roller 13 might be 0.009± 0.002 inches. The fact that dimension F is substantially less than the normal radial compression of roller 13 against fusing roller 12 assures that compression will be maintained across the full width of the rollers while accommodating the greater degree of thermal expansion that will occur across the transverse sections 22 when feeding relatively narrow continuous length print stock.

The stepped configuration of pressure roller 13 as shown in FIGS. 3-5 constitutes a first form of means for compensating for differences in thermal expansion conditions encountered across the identified transverse sections of the rollers when handling differing print stock widths or thicknesses. By reducing the amount of thermal expansion occurring across the illustrated sections 22, this modification assists in maintaining constant the linear speed imparted to continuous length print stock by the rollers as the print stock passes through the rolling nip independently of print stock width.

The arrangement illustrated in FIGS. 3-5 further includes a heat transfer roller 24 rotatably mounted to frame 18 by means of a protruding shaft 25. To assure good rolling contact and engagement between rollers 13 and 24, it is preferred that the supporting shaft 25 carrying it be cammed or spring biased toward the opposed surfaces of the pressure roller 13.

Heat transfer roller 24 might be constructed of tubular or solid metal or other material having substantial heat conducting properties, typically copper or aluminum. Its heat conductive outer surface overlaps and engages the outer surfaces of pressure roller 13 to redistribute heat across its width. This normalization of surface temperature helps to maintain thermal balance across the width of the pressure roller 13 and assists in preventing any transverse sections across its width from expanding abnormally relative to its center section that always engages the print stock 14 regardless of print stock width.

It is to be understood that the heat transfer roller 24 can be used in conjunction with the stepped configuration of pressure roller 13 (as shown in FIGS. 3-5), or can be used alone in conjunction with a conventional pressure roller 13 of constant diameter (as shown in FIG. 12), or can be used in conjunction with any of the other alternate embodiments shown in the remaining drawing figures. In each instance, the heat transfer roller 24 will frictionally engage and roll against the outer surfaces of the pressure roller 13 to redistribute heat across its surface(s) as the rollers 12 and 13 turn about their respective axes.

An alternative heat transfer arrangement might involve modification of the relative thicknesses of the underlying metal tube and elastomeric cover in the structure of pressure roller 13. By using a thicker heat conductive metal tube and an elastomeric cover having reduced radial thickness, one can assure more efficient heat transfer and greater normalization of surface temperatures across pressure roller 13.

Figure 7:
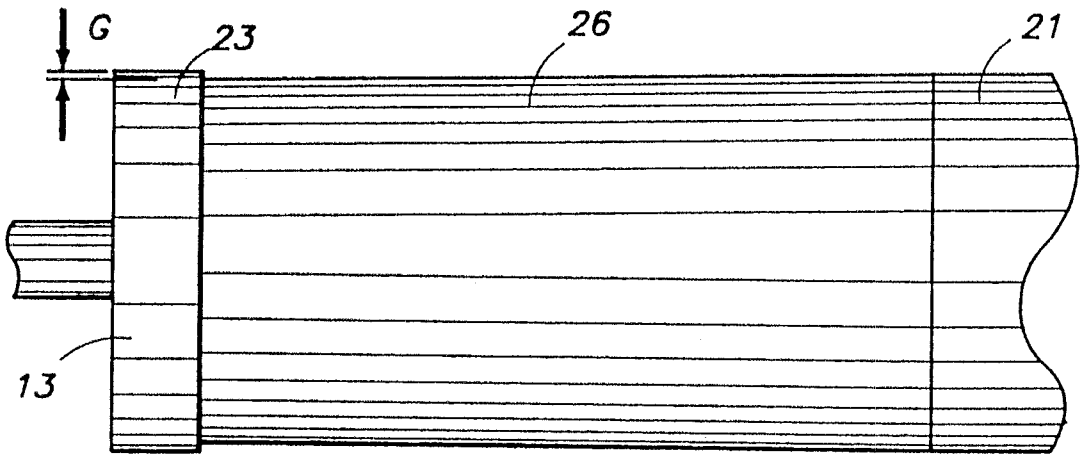
FIG. 7 is an enlarged transverse elevation view of one end of the pressure roller shown in FIG. 6.

FIGS. 6 and 7 illustrate a variation of the stepped pressure roller. In this embodiment, the pressure roller 13 includes the same central cylindrical transverse section 21 and end sections 23 as previously disclosed, but the transverse sections 26 that extend outwardly from section 21 are tapered. The outside diameters at the outer ends of the tapered transverse sections 26 are less than the outside diameter of the central cylindrical transverse section 21. The difference in diameter at this point is illustrated at G in FIG. 7. The size of this difference in relation to the amount of radial compression of pressure roller 13 against fusing roller 12 should be substantially the same as discussed above with respect to the dimensional relationship between the diameters of stepped sections 22 and central section 21 in FIGS. 3-5. As previously described, the differences in diameter are designed to normalize the diameter across pressure roller 13 as the tapered transverse sections 26 are directly exposed to heat from fusing roller 12 when handling relatively narrow continuous length print stock.

FIGS. 8 and 9 illustrate an alternate approach to thermal compensation across the exterior of pressure roller 13. In this arrangement, thermal compensation is accomplished by heating the central transverse section of the roller. A heater 27 is directed to the exterior of the roller and spans the width of its central transverse section. The heater can be either active or passive (a mirror). It is illustrated as a concave heating element directly adjacent to roller 13.

The heater will reflect and retain heat across the overlapped width of the pressure roller 13, thereby tending to increase the surface temperature of the overlapped section in relation to the surface temperatures across the remainder of pressure roller 13. The additional heat or retention of heat achieved by provision of heater 27 compensates for the increasing surface temperatures across the outer sections of pressure roller 13 when handling continuous length narrow stock or stock of differing thicknesses.

Figure 11:
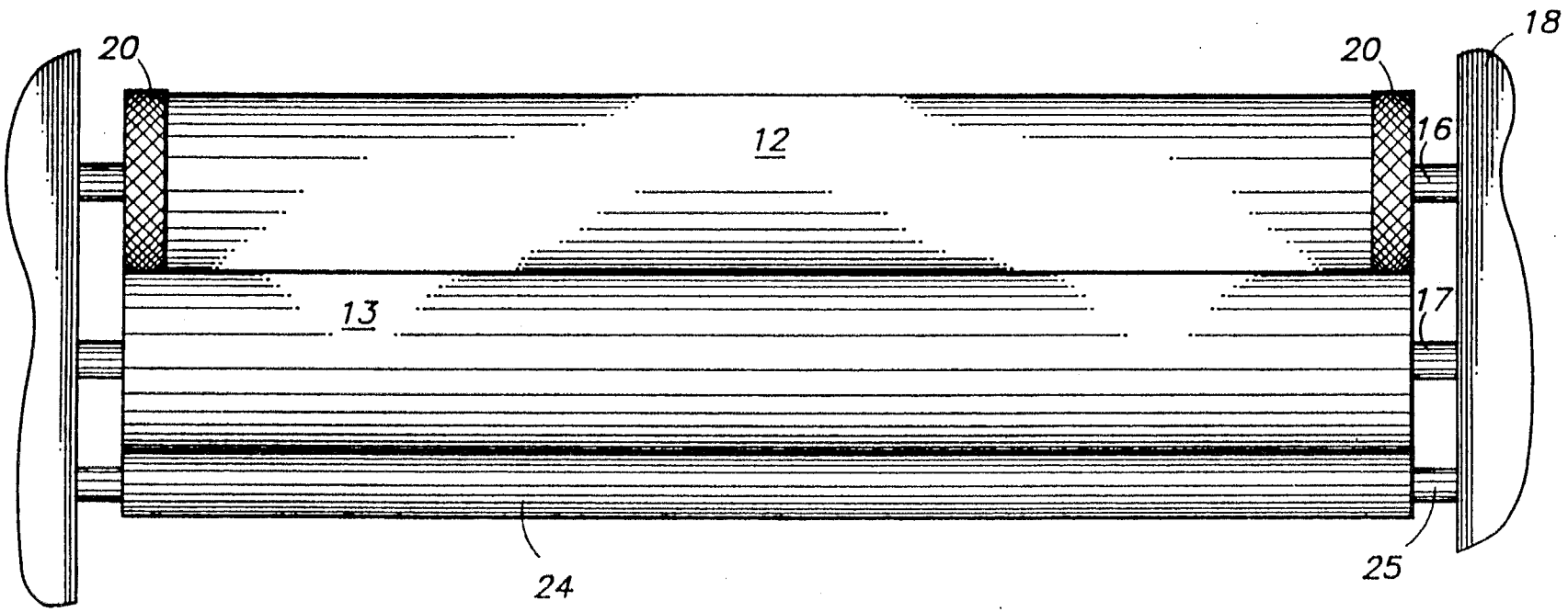
FIG. 11 is a cross-sectional view taken along line 11—11 in FIG. 10.
Figure 11:
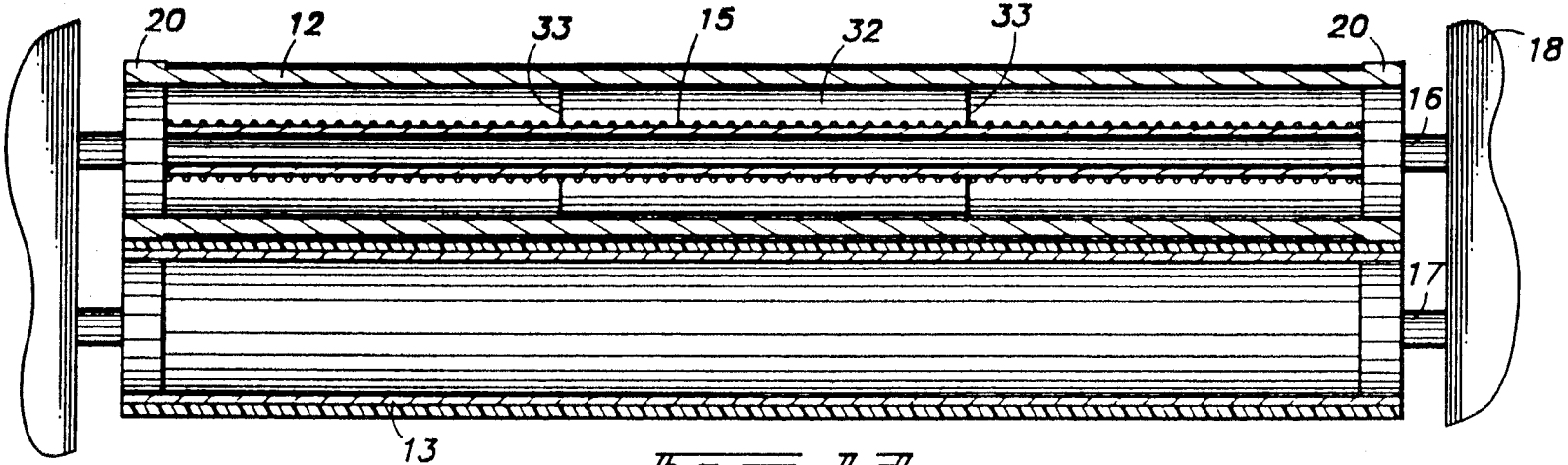
Figure 11A:
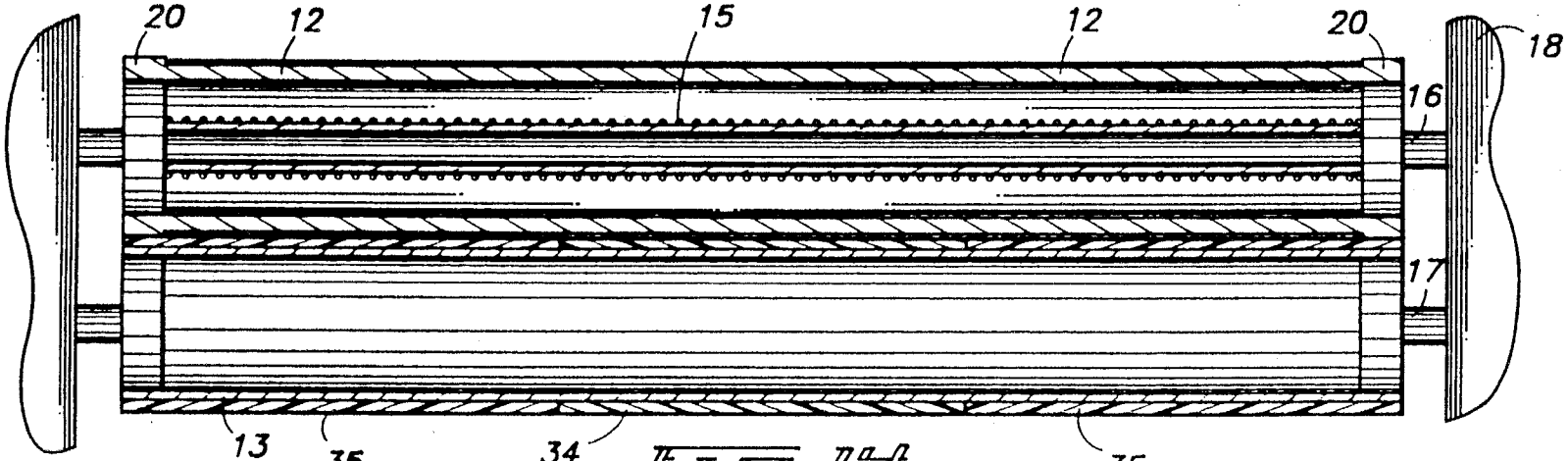

Another alternative is generally illustrated in FIGS. 10 and 11. In this instance, thermal compensation is accomplished by cooling the outer sections of pressure roller 13 relative to a central transverse section generally corresponding to the minimum stock width to be handled in the roll-fusing apparatus. Concave cooling plenums 28 are provided with pressurized air or gas through a supply tube 30. The plenums 28 direct cool pressurized air or gas through a plurality of jets 31 that overlap the selected transverse exterior sections of the pressure roller 13. By providing a source of cooling air directed to the selected sections of the pressure roller across its width, temperature compensation can be achieved to maintain a normalized or average temperature across the full roller width when handling narrow width or thicker print stock.

FIG. 13 illustrates another thermal compensation system. One conventional configuration of fuser roller 12 includes an opaque coating 32 extending continuously about the inner surface of the metal tubular roller to absorb heat and improve heat transfer between the heating element 15 and surrounding metal fusing roller 12. According to this embodiment of the invention, the transverse boundaries of the opaque or heat-absorbing coating 32 terminate along circumferential edges 33. The spacing between edges 33 is substantially equal to the width of the central transverse section A illustrated in FIG. 2. Thus, a greater degree of heat transfer will occur across the central transverse section A than across the outer sections of the fusing roller 12. The resulting heat pattern transferred to the contacting surfaces of pressure roller 13 will reduce the surface temperatures across its corresponding outer sections.

Similar results can be achieved by applying differing exterior coatings about the exterior of fusing roller 12 across corresponding transverse roller sections.

A final embodiment of the invention is illustrated in FIG. 14. In this arrangement, the conventional fusing roller 12 is paired with a modified pressure roller 13 having differing exterior coatings provided to the pressure roller 13 about one or more sections across its width. As illustrated, there is a central section 34 of elastomeric material that differs from the material used about the outer sections 35. The differing exterior coatings across the pressure roller 13 should have different coefficients of expansion, which again will serve to normalize expansion across the modified roller 13 to compensate for temperature differences that might be encountered when handling narrow width or thicker print stock.

In general, the novel modifications presented by this disclosure involve the addition of structure to compensate for differences in thermal expansion conditions encountered across transverse sections of the rollers when engaged by differing print stock widths or thicknesses. These modifications are illustrated in FIGS. 3–5 (stepped roller sections and heat transfer roller), FIGS. 6 and 7 (tapered roller sections), FIGS. 8 and 9 (supplemental heater), FIGS. 10 and 11 (supplemental cooler), FIG. 12 (heat transfer roller alone), FIG. 13 (discontinuous heat absorbing coating) and FIG. 14 (differing exterior coatings).

The present method for moving continuous length print stock through the roll-fusing assembly comprises the steps of powering the fusing roller 12 at a constant rotational speed, driving the pressure roller 13 from the fusing roller 12 to synchronize their rotational speeds at the rolling nip, centering continuous length print stock of a selected width across the rollers while directing it into the rolling nip at a constant linear speed imparted by the feeding assembly 11, and compensating for differences in thermal expansion conditions encountered across the transverse sections of the rollers 12 and 13 when handling different print stock widths or thicknesses. The step of compensating for differences in thermal expansion conditions across selected transverse sections of the rollers will maintain uniformity of linear speed imparted to continuous length print stock by the rollers as it passes through the rolling nip.

As illustrated in FIGS. 3–5 and FIGS. 6 and 7, the compensating step can be carried out by varying the diameter of the pressure roller 13 across its width. This can involve a reduction of the diameter of selected sections of the pressure roller across its width by forming stepped sections (FIGS. 3–5) or tapered sections (FIGS. 6 and 7).

The compensating step can also be carried out by redistributing heat across the width of the pressure roller, such as by contact with a heat transfer roller 24 (FIGS. 3, 4 and 12).

The compensating step can further be carried out by cooling or heating one or more selected sections of the pressure roller 13 across its width, as illustrated in FIGS. 8–11. It might also be carried out by varying the exterior temperature of the fusing roller about one or more sections across its width, as illustrated in FIG. 13, where only the central transverse section of fusing roller 13 is provided with an interior heat-absorbing coating 32. Finally, the compensating step can be carried out by use of differing exterior coatings arranged about the exterior of one of the rollers, as exemplified by coatings 34 and 35 on pressure roller 13 in FIG. 14.

The method might also involve a compensating step comprising a combination of two or more of the previously described steps.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A method for moving continuous length print stock between paired pressure and fusing rollers rotatably mounted alongside one another in the fuser section of an electrophotographic printer, the rollers being designed to engage opposite surfaces of continuous length print stock selected from substantially different minimum and maximum print stock widths and thicknesses as it passes through a rolling nip between the rollers, comprising the following steps:

powering the fusing roller at a constant rotational speed;

driving the pressure roller from the fusing roller to synchronize their rotational speeds at the rolling nip;

centering continuous length print stock of a selected width across the rollers while directing it into the rolling nip at a constant linear speed; and compensating for differences in thermal expansion conditions encountered across the rollers when handling differing print stock widths and thicknesses to thereby maintain uniformity of linear speed imparted to continuous length print stock by the rollers as it passes through the rolling nip.

2. The method of claim 1, wherein the compensating step is carried out across the rollers between central transverse sections that are slightly less wide than the minimum print stock width and outer transverse sections of added width extending outward from the ends of the central transverse sections beyond the maximum print stock width.

3. The method of claim 1, wherein the compensating step is carried out by varying the diameter of the pressure roller across its width.

4. The method of claim 1, wherein the compensating step is carried out by reducing the diameter of selected sections of the pressure roller across its width.

5. The method of claim 1, wherein the compensating step is carried out by tapering the diameter of selected sections of the pressure roller across its width.

6. The method of claim 1, wherein the compensating step is carried out by redistributing heat across the width of the pressure roller.

7. The method of claim 1, wherein the compensating step is carried out by reducing the diameter of selected sections of the pressure roller across its width and by redistributing heat across the width of the pressure roller.

8. The method of claim 1, wherein the compensating step is carried out by cooling one or more selected sections of the pressure roller across its width.

9. The method of claim 1, wherein the compensating step is carried out by supplementing the heat applied to one or more selected sections of the fusing roller by the fusing roller.

10. The method of claim 1, wherein the compensating step is carried out by varying the material comprising the exterior coating of the pressure roller about one or more sections across its width.

11. A roll-fusing assembly for moving continuous length print stock between paired pressure and fusing rollers rotatably mounted alongside one another in the fuser section of an electrophotographic printer, the rollers being designed to engage opposite surfaces of continuous length print stock selected from substantially different minimum and maximum print stock widths and thicknesses as it passes through a rolling nip between the rollers, comprising:

a heated fusing roller;

a pressure roller adjacent to and in pressing engagement with the fusing roller; and means for compensating for differences in thermal expansion conditions encountered across the rollers when handling differing print stock widths and thicknesses to thereby maintain uniformity of linear speed imparted to continuous length print stock by the rollers as it passes through the rolling nip.

12. The roll-fusing assembly of claim 11, wherein the rollers include central transverse sections having a width slightly less than or equal to the minimum print stock width and outer transverse sections of added width extending outward from the ends of the central transverse sections beyond the maximum print stock width.

13. The roll-fusing assembly of claim 11, wherein the means for compensating for thermal expansion conditions comprises:

stepped cylindrical surfaces of differing outer diameters formed across transverse sections of one of the rollers.

14. The roll-fusing assembly of claim 11, wherein the means for compensating for differences in thermal expansion conditions comprises:

stepped cylindrical transverse sections formed across one of the rollers and extending outwardly from a central cylindrical transverse section, the outer diameters of the stepped cylindrical transverse sections being less than the outer diameter of the central cylindrical transverse section.

15. The roll-fusing assembly of claim 11, wherein the means for compensating for differences in thermal expansion conditions comprises:

tapered transverse sections formed across one of the rollers and extending outward from a central cylindrical transverse section.

16. The roll-fusing assembly of claim 11, wherein the means for compensating for differences in thermal expansion conditions comprises:

tapered transverse sections formed across one of the rollers and extending outward from a central cylindrical transverse section, the outer diameters at the outer ends of the tapered transverse sections being less than the outer diameter of the central cylindrical transverse section.

17. The roll-fusing assembly of claim 11, wherein the means for compensating for differences in thermal expansion conditions comprises:

a heat transfer roller rotatably mounted alongside the pressure roller, the heat transfer roller having a heat-conductive outer surface overlapping and engaging the outer surfaces of the pressure roller for distributing heat across the width of the pressure roller.

18. The roll-fusing assembly of claim 11, wherein the means for compensating for differences in thermal expansion conditions comprises:

a source of cooling air directed to one or more selected sections of the pressure roller across its width.

19. The roll-fusing assembly of claim 11, wherein the means for compensating for differences in thermal expansion conditions comprises:

a source of supplemental heat directed to one or more selected sections of the pressure roller across its width.

20. The roll-fusing assembly of claim 11, wherein the means for compensating for differences in thermal expansion conditions comprises:

differing exterior coatings provided to the pressure roller about one or more sections across its width.

21. A roll-fusing assembly for moving continuous length print stock between paired pressure and fusing rollers rotatably mounted alongside one another in the fuser section of an electrophotographic printer, the rollers being designed to engage opposite surfaces of continuous length print stock selected from substantially different minimum and maximum print stock widths and thicknesses as it passes through a rolling nip between the rollers, comprising:

a heated fusing roller;

a pressure roller adjacent to and in pressing engagement with the fusing roller; and stepped cylindrical surfaces of differing outer diameters formed across transverse sections of one of the rollers;

the roll-fusing assembly further comprising:

a heat transfer roller rotatably mounted alongside the pressure roller, the heat transfer roller having a heat-conductive outer surface overlapping and engaging the outer surfaces of the pressure roller for distributing heat across the width of the pressure roller.

22. A roll-fusing assembly for moving continuous length print stock between paired pressure and fusing rollers rotatably mounted alongside one another in the fuser section of an electrophotographic printer, the rollers being designed to engage opposite surfaces of continuous length print stock selected from substantially different minimum and maximum print stock widths and thicknesses as it passes through a rolling nip between the rollers, comprising:

a heated fusing roller;

a pressure roller adjacent to and in pressing engagement with the fusing roller; and stepped cylindrical transverse sections formed across the pressure roller and extending outwardly from a central cylindrical transverse section, the outer diameters of the stepped cylindrical transverse sections being less than the outer diameter of the central cylindrical transverse section;

the roll-fusing assembly further comprising:

a heat transfer roller rotatably mounted alongside the pressure roller, the heat transfer roller having a heat-conductive outer surface overlapping and engaging the outer surfaces of the pressure roller for distributing heat across the width of the pressure roller.

23. A roll-fusing assembly for moving continuous length print stock between paired pressure and fusing rollers rotatably mounted alongside one another in the fuser section of an electrophotographic printer, the rollers being designed to engage opposite surfaces of continuous length print stock selected from substantially different minimum and maximum print stock widths and thicknesses as it passes through a rolling nip between the rollers, comprising:

a heated fusing roller;

a pressure roller adjacent to and in pressing engagement with the fusing roller, the pressure roller being mounted so to be compressed against the fusing roller by a preselected radial dimension following an initial warm-up period;

each of the pressure and fusing rollers including a central transverse section that is slightly less wide than the minimum print stock width and an outer transverse section of added width extending outward from the ends of its central transverse section beyond the maximum print stock width; and means for compensating for differences in thermal expansion conditions encountered across the rollers when handling differing print stock widths and thicknesses to thereby maintain uniformity of linear speed imparted to continuous length print stock by the rollers as it passes through the rolling nip.

24. The roll-fusing assembly of claim 23, wherein the means for compensating for differences in thermal expansion conditions comprises:

a cylindrical surface formed across the central transverse section of the pressure roller; and stepped cylindrical surfaces formed across the outer transverse sections of the pressure roller, the outer diameters of the stepped cylindrical surfaces being less than the outer diameter of the cylindrical surface formed across the central transverse section of the pressure roller.

25. The roll-fusing assembly of claim 23, wherein the means for compensating for differences in thermal expansion conditions comprises:

a cylindrical surface formed across the central transverse section of the pressure roller; and stepped cylindrical surfaces formed across the outer transverse sections of the pressure roller, the outer diameters of the stepped cylindrical surfaces being less than the outer diameter of the cylindrical surface formed across the central transverse section of the pressure roller and the differences between the outer diameters of the stepped cylindrical surfaces and the outer diameter of the cylindrical surface formed across the central transverse section of the pressure roller being less than the preselected radial dimension.

26. The roll-fusing assembly of claim 23, wherein the means for compensating for differences in thermal expansion conditions comprises:

a cylindrical surface formed across the central transverse section of the pressure roller; and tapered surfaces formed across the outer transverse sections of the pressure roller, the outer diameters at the outer ends of the tapered surfaces being less than the outer diameter of the central cylindrical transverse section.

* * * * *